US005614479A

United States Patent [19]

Chardon

[11] Patent Number: 5,614,479

[45] Date of Patent: Mar. 25, 1997

[54] CORROSION INHIBITOR

[76] Inventor: John W. Chardon, Unit 2/10 Lawrence Dr., P.O. Box 296, Nerang, Q. 4211, Australia

[21] Appl. No.: 501,782

[22] Filed: Jul. 13, 1995

[51] Int. Cl.[6] ..... C10M 141/02; C10M 141/06

[52] U.S. Cl. ..... 508/283; 508/463; 508/577

[58] Field of Search ..... 252/52 R, 51.5 R, 252/56 R; 508/283, 463, 577

[56] References Cited

U.S. PATENT DOCUMENTS 5,102,567 4/1992 Wolf ..... 252/52 R 5,182,035 1/1993 Schmidt et al. ..... 252/52 R 5,185,091 2/1993 Ozake et al. ..... 252/52 R

*Primary Examiner*—Jacqueline V. Howard

*Attorney, Agent, or Firm*—Weintraub, DuRoss & Brady

[57] ABSTRACT

A food-grade corrosion inhibitor for admixture with a food-grade petroleum-based oil is derived from an admixture of food-grade components. The corrosion inhibitor, a food-grade ketone, a food-grade ester and imidazoline. The additive is incorporated into a lubricating component such as mineral oil, etc.

10 Claims, No Drawings

CORROSION INHIBITOR

BACKGROUND OF THE INVENTION

1. Field of the Invention

The present invention concerns corrosion inhibitors. More particularly, the present invention relates to corrosion inhibitors for use with lubricants. Even more particularly, the present invention concerns food grade corrosion inhibitors for use with lubricants and lubricants prepared therefrom.

2. Prior Art

As is known to those skilled in the art, lubricants are used in practically every environment where two parts undesirably mesh or rub together to create friction. Thus, every conceivable type of machinery including, for example, vehicles, factory equipment, agricultural equipment, simple mechanical devices, such as lawn mowers, etc. all employ lubricants of some sort to minimize the wear and tear and to reduce friction.

Lubricants chemical comprise various compositions. While, per se, each type of lubricant is selected upon the environment in which it is employed, petroleum-based oil compositions are the most widely employed lubricants. Other lubricant compositions are the soap-type lubricants prepared from organic fatty acids, as well as synthetic lubricant compositions based upon diamines, silicones, etc.

For example, within the food processing industry, lubricants are employed for maintaining lubricity between conveyors and the containers passing therealong. Likewise, food-handling equipment such as fillers, sprayers, etc. also employ lubricants. It is to be appreciated that because of the environment in which the lubricants are employed it is essential that the lubricant not contaminate the comestible which is being processed at the location. Such contamination creates obvious difficulties and potential hazards. Thus, great care must be taken not only in lubricant selection, but lubricant use as well.

Alternatively, in machining plants lubricants must be used for conveyors, transmissions, etc. Although contamination may not be a problem, it is essential to the creation or formulation of a good lubricant that a corrosion inhibitor be incorporated therewith. Just as bacteriostatic compounds, buffers, etc. must be incorporated into such formulations, necessarily, because of the environments in which the lubricants are employed, it is essential that corrosion inhibitors be incorporated therewith in order to enhance the efficacy of the lubricant, per se.

It is to be appreciated, again, that in a food processing environment it would be most advantageous to employ a food-grade corrosion inhibitor which can be easily admixed and incorporated into the lubricant to thereby further reduce the hazards attendant the use of such lubricant. Furthermore, it is to be appreciated that a food-grade corrosion inhibitor also reduces the risk of using lubricants where the potential for ingestion of the lubricant, whether by accident or otherwise, is a potential.

Thus, the present invention, as will be subsequently detailed, provides a corrosion inhibitor comprising an admixture of food-grade additives.

SUMMARY OF THE INVENTION

In accordance with the present invention there is provided a corrosion inhibitor comprising an admixture of:

(a) a food-grade ester;

(b) a food-grade ketone; and (c) an imidazoline.

The components hereof are, as noted, food-grade components. By the term "food-grade" is meant those compounds which have been denoted by the Federal Government and, in particular, the Food and Drug Administration, as being acceptable in foodstuffs or which can be used in environments which come into contact with foodstuffs.

The food-grade esters can comprise a single ester or mixtures thereof. Likewise, the ketone, which is preferably a cycloaliphatic ketone, can also comprise a mixture thereof.

The composition hereof can be admixed with any suitable lubricant composition. Preferably, it is admixed with a food-grade petroleum distillate lubricant composition, such as mineral oil.

For a more complete understanding of the present invention, reference is made to the following detailed description and accompanying illustrative examples.

DESCRIPTION OF THE PREFERRED EMBODIMENT

As noted, and in accordance with the present invention there is provided a food-grade corrosion inhibitor for use with lubricating compositions or lubricants, as well as the resulting lubricant composition.

The corrosion inhibitor hereof generally comprises an admixture of:

(a) a food-grade ester;

(b) a food-grade ketone; and (c) imidazoline.

The corrosion inhibitor comprises an admixture of the components which can be admixed with a suitable lubricant, such as a petroleum-based lubricant, preferably mineral oil, to form the use lubricant hereof.

The ketone which is used herein is either an aliphatic or alicyclic ketone. Preferably, the ketone is a higher aliphatic or alicyclic ketone. As contemplated herein, the term "higher fatty ketones" means those ketones which correspond to the formula R—C—R' wherein R ranges from about $C_{12}$ to about $C_{20}$, and R' ranges from about 1 to 3, as well as mixtures thereof.

Among the useful R groups are, for example, oleates, palmitates, laureates, lineoleates and the like, as well as mixtures thereof.

R' may be methyl, ethyl, propyl, etc. or the like, as well as mixtures thereof.

Amongst the useful ketones particularly preferred are those ketones corresponding to the formula R—C—R' where R is $C_{12}$ to $C_{16}$ and R' is methyl and mixtures thereof. In practicing the present invention mixtures of both aliphatic and alicyclic ketones may be used.

The alicyclic ketone which is particularly advantageous for use herein is cyclohexanone.

In use, the ketone is present in an amount ranging from about 30% to about 90%, by weight, based upon the total weight of the additive.

The food-grade ester is traditionally noted as one derived from a fatty acid. The fatty acids are similar to those enumerated herein above with respect to the higher fatty acid-based ketones. Indeed, in the practice of the present invention it is preferred that the fatty acid portion of the ketone be the same as that for the ester. Thus, the fatty acid esters utilized herein corresponds to the formula: R"—C—OR'" wherein R" generally is a hydrocarbon radical having from about 12 to about 20 carbon atoms in the alkyl portion thereof. R''' is preferably a lower alkyl such as methyl, ethyl, propyl or the like. Amongst the useful higher fatty acid-based esters are, for example, oleates, palmitates, laureates, linoleates, and the like as well as mixtures thereof.

In practicing the present invention, the ester is present in an amount ranging from about 3.0% to about 40%, by weight, based upon the total weight of the composition, and preferably is present in an amount ranging from about 3.0 to about 15%, by weight.

In practicing the present invention it is advantageous that the organic portion of the ester and the ketone be the same. In other words, when R' is path palmitate, it is highly desirable, although not essential, that R'' likewise be palmitate.

The imidazoline is present in an amount ranging from about 3.0 to about 20%, by weight, based upon the total weight of the solution, and is preferably present in an amount ranging from about 3.0 to about 15%, by weight, based upon the total weight of the composition.

The composition hereof is prepared by admixing the components together under ambient conditions.

In use, the corrosion inhibitor hereof is preferably admixed with any suitable petroleum-based lubricant. Generally, the corrosion inhibitor hereof comprises from about 3 to about 20% by weight, based upon the total weight of the paraffin? and additive.

Preferably, the petroleum-based lubricant is mineral oil. The mineral oil defines a transport medium into which the additive can be readily added and admixed thereof. Since the other components are organic in nature, the components are readily admixed with the mineral oil without separation or suspension. The term "mineral oil" as used herein defines a refined hydrocarbon oil without animal or vegetable additives. Mineral oil, as such, is a widely known and commercially available product. A particularly preferred refined grade of mineral oil which is denoted as mineral oil is "white oil".

In practicing the present invention, generally, the white oil comprises from about 80–97%, by weight, of the total composition hereof. Preferably, the white oil is present in an amount ranging from about 85 to about 95% by weight, based upon the total weight of the composition.

In this regard, other food-grade lubricants, such as glycerine or glycerol, coconut oil, etc. and the like, as well as mixtures thereof, may be used herein. However, the white oil is preferred.

The additive hereof is admixed with the lubricant by any conventional means at ambient conditions.

The composition hereof is solvent neutral and may be used in any of a wide variety of environments. In addition to its utility as a lubricant, the composition also functions as a functional fluid, such as an automatic transmission fluid, brake fluid or the like.

For a more complete understanding of the present invention, reference is made to the following Examples. In the Examples, which are to be construed as illustrative rather than limitative of the present invention, all parts are by weight absent indications to the contrary.

EXAMPLE I

Into a suitable vessel equipped with stirring means is added the following at room temperature:

| Ingredient | Amount, pbw |
|---|---|
| Methyl lauryl ketone | 7.0 |
| Methyl laureate | 2.0 |
| Imidazoline | 1.0 |

The above composition is then admixed with 90 parts of white oil at ambient conditions. The resulting composition is useful as a transmission fluid.

EXAMPLE II

This example illustrates the preparation of a lubricant composition in accordance herewith.

Into a suitable vessel equipped with a suitable stirrer is charged? a quantity of white oil. To the white oil is added serially? food grade corrosion inhibiting components to form a lubricant.

The following sets forth the components and the amounts thereof.

| Ingredient | Amount, pbw |
|---|---|
| White oil | 83.0 |
| Cyclohexanone | 8.0?? |
| Methyl laurate | 5.0 |
| Imidazoline | 4.0 |

Having thus described the invention, what is claimed is:

1. A food-grade corrosion inhibitor for use in a lubricant composition, comprising:

(a) from about 30% to about 90%, by weight, based on the total weight of the inhibitor, of a food-grade ketone;

(b) from about 3.0% to about 40%, by weight, based on the total weight of the inhibitor, of a food-grade ester; and (c) from about 3.0% to about 20%, by weight, based on the total weight of the inhihitor, of imidazoline.

2. The composition of claim 1 wherein the ketone corresponds to the formula $$R-\overset{\overset{\displaystyle O-}{\|}}{C}-R'$$

wherein R and R' are each hydrocarbon radicals, R ranging form about $C_{12}$ to about $C_{20}$ and R' is lower alkyl having from 1 to 3 carbon atoms in the alkyl portion thereof.

3. The corrosion inhibitor of claim 1 wherein the ester corresponds to the formula $$R''-\overset{\overset{\displaystyle O}{\|}}{C}-OR''',$$

wherein R'' is a hydrocarbon radical, saturated or unsaturated, having from about $C_{12}$ to about $C_{20}$ in the hydrocarbon portion thereof and R''' is lower alkyl ranging from about C1 to C3.

4. The corrosion inhibitor of claim 2 wherein the ester corresponds to the formula:

$$R''-\overset{\overset{\displaystyle O}{\|}}{C}-OR'''$$

wherein R" is a hydrocarbon radical, saturated or unsaturated, having from about $C_{12}$ to about $C_{20}$ in the hydrocarbon portion thereof and R'" is lower alkyl ranging from about $C_1$ to about $C_3$.

5. The composition of claim 3 wherein R' and R" are the same.

6. A lubricant comprising:

(a) a major amount of mineral oil; and (b) the inhibitor of claim 1.

7. The lubricant of claim 6 wherein the mineral oil is white oil.

8. The lubricant of claim 6 which comprises, by weight, based on the total weight, (a) from about 80% to about 97% of the mineral oil; and (b) from about 3% to about 20% of the additive.

9. The lubricant of claim 6 wherein:

the ketone is an alicyclic ketone.

10. The lubricant of claim 6 wherein:

the ketone is cyclohexanone.

* * * * *